US010151222B2

(12) United States Patent
Burke et al.

(10) Patent No.: US 10,151,222 B2
(45) Date of Patent: Dec. 11, 2018

(54) ELECTRIC CAM PHASING SYSTEM INCLUDING AN ACTIVATABLE LOCK

(71) Applicant: Schaeffler Technologies AG & Co. KG, Herzogenaurach (DE)

(72) Inventors: Steven Burke, Fort Gratiot, MI (US); Andrew Mlinaric, Tecumseh (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 48 days.

(21) Appl. No.: 15/278,200

(22) Filed: Sep. 28, 2016

(65) Prior Publication Data

US 2018/0087411 A1 Mar. 29, 2018

(51) Int. Cl.

*F01L 1/352* (2006.01)
*F01L 1/047* (2006.01)
*F01L 1/344* (2006.01)

(52) U.S. Cl.

CPC ..... *F01L 1/352* (2013.01); *F01L 1/047* (2013.01); *F01L 2001/0476* (2013.01); *F01L 2001/34453* (2013.01); *F01L 2001/34469* (2013.01); *F01L 2001/3521* (2013.01); *F01L 2250/02* (2013.01); *F01L 2250/04* (2013.01); *F01L 2250/06* (2013.01); *F01L 2800/01* (2013.01); *F01L 2820/032* (2013.01)

(58) Field of Classification Search

CPC ... F01L 1/352; F01L 2001/3521; F01L 1/344; F01L 1/34; F01L 9/04; F01L 2009/0401; F01L 2009/0411; F01L 2103/00; Y02T 10/18

See application file for complete search history.

(56) References Cited

U.S. PATENT DOCUMENTS 4,403,579 A * 9/1983 Young ..... F02P 7/10 123/146.5 A
4,806,809 A * 2/1989 Kubota ..... F16D 1/10 310/75 D
7,377,245 B2 5/2008 Morii et al.
8,677,961 B2 3/2014 Fischer
(Continued)

FOREIGN PATENT DOCUMENTS

WO WO2014/065132 A1 5/2014

OTHER PUBLICATIONS

Corresponding Search Report and Written Opinion for PCT/US2017/052878.

*Primary Examiner* — Mark Laurenzi
*Assistant Examiner* — Wesley Harris
(74) *Attorney, Agent, or Firm* — Davidson, Davidson & Kappel, LLC

(57) ABSTRACT

An electric cam phasing system is provided. The electric cam phasing system includes an electric motor including a center shaft; a camshaft; a center fastener extending into a center of the camshaft and a gearbox including a sprocket and a drive unit. The drive unit includes an input shaft coupling connected to the center shaft. The drive unit is configured for coupling the camshaft to the sprocket in a manner such that relative phasing of the camshaft with respect to sprocket is adjustable via the electric motor driving the drive unit. The electric cam phasing system also includes a lock positioned axially between the center shaft and the camshaft, the lock being configured for selectively engaging the center fastener to lock the gearbox.

20 Claims, 10 Drawing Sheets

(56) References Cited

U.S. PATENT DOCUMENTS

| | | | | |
|---|---|---|---|---|
| 2005/0199201 | A1 | 9/2005 | Schafer et al. | |
| 2011/0030631 | A1 | 2/2011 | David et al. | |
| 2012/0060779 | A1 | 3/2012 | Adachi et al. | |
| 2013/0019825 | A1* | 1/2013 | Fischer ..... | F01L 1/352 123/90.15 |
| 2013/0212880 | A1 | 8/2013 | Eimert | |
| 2015/0285105 | A1 | 10/2015 | Numakura et al. | |

* cited by examiner

-Prior Art-

-Prior Art-

ELECTRIC CAM PHASING SYSTEM INCLUDING AN ACTIVATABLE LOCK

The present disclosure relates generally to electric cam phasing systems and more specifically to electric cam phasing systems including locks.

BACKGROUND

EP 1813783 B1, U.S. Pat. No. 8,677,961 B2, and U.S. Pat. No. 7,377,245 B2 disclose electric cam phasing systems.

FIG. 1*a* shows a cross-sectional side view of a conventional electric cam phasing system 100 and FIG. 1*b* shows an isometric view of a portion of system 100. Cam phasing system 100 includes an electric motor 102 for adjusting a position of a camshaft 106 relative to a sprocket 104. Sprocket 104 couples the camshaft 106 to a crankshaft via a chain, belt, or gearing. System 100 includes a drive element 108 at an end of a shaft 110 of motor 102 that is non-rotatably connected to an input shaft coupling 112 of a gearbox 114. Both ends of drive element 108 fit into a slot in the coupling 112 of the gearbox 114. During engine start-up and shutdown, rotation between camshaft 106, which includes a gearbox central bolt 116 therein, and gearbox input shaft coupling 112 could occur, changing the valve timing. Upon cold start conditions, the system 100 must learn its position, which takes a very short time but still requires movement of the camshaft to do so.

SUMMARY OF THE INVENTION

An electric cam phasing system is provided. The electric cam phasing system includes an electric motor including a center shaft; a camshaft; a center fastener extending into a center of the camshaft and a gearbox including a sprocket and a drive unit. The drive unit includes an input shaft coupling connected to the center shaft. The drive unit is configured for coupling the camshaft to the sprocket in a manner such that relative phasing of the camshaft with respect to sprocket is adjustable via the electric motor driving the drive unit. The electric cam phasing system also includes a lock positioned axially between the center shaft and the camshaft, the lock being configured for selectively engaging the center fastener to lock the gearbox.

A method of constructing an electric cam phasing system is also provided. The method includes nonrotatably fixing an input shaft coupling of a drive unit of a gearbox to a center shaft of an electric motor, the drive unit coupling a camshaft to a sprocket in a manner such that relative phasing of the camshaft with respect to the sprocket is adjustable via the electric motor driving the drive unit; fixing the drive unit to the camshaft via a center fastener extending into a center of the camshaft; and providing a lock positioned axially between the center shaft and the camshaft, the lock being configured for selectively engaging the center fastener to lock the gearbox.

BRIEF DESCRIPTION OF THE DRAWINGS

The present invention is described below by reference to the following drawings, in which.

DETAILED DESCRIPTION

The present disclosure provides a locking device that is activated by a locking pin inside of the gearbox central bolt to provide a locking of the gearbox input shaft coupling to the gearbox central bolt head. The locking pin is actuated by oil pressure that is supplied from the engine's oil circuit through the cam bearing and into a center passage of the bolt. The locking device includes a bias spring and is arranged to be pressurelessly locked, such that an inherent decrease in oil pressure during engine shutdown will facilitate engagement of the locking device with the head of the central bolt; the locking device inner diameter has the form of a socket tool to engage the shape of the head of the central bolt. The locked position is maintained during engine shutdown and also during engine start-up until enough oil pressure is provided to an end of the locking pin to overcome the force of the bias spring of the locking device and any inherent friction between mating components. Another feature of the lock is that any position can be chosen between the range of authority (within the angular resolution of the locking positions) to lock the phaser movement. Locking is not limited to one or two positions.

Figure 1A:
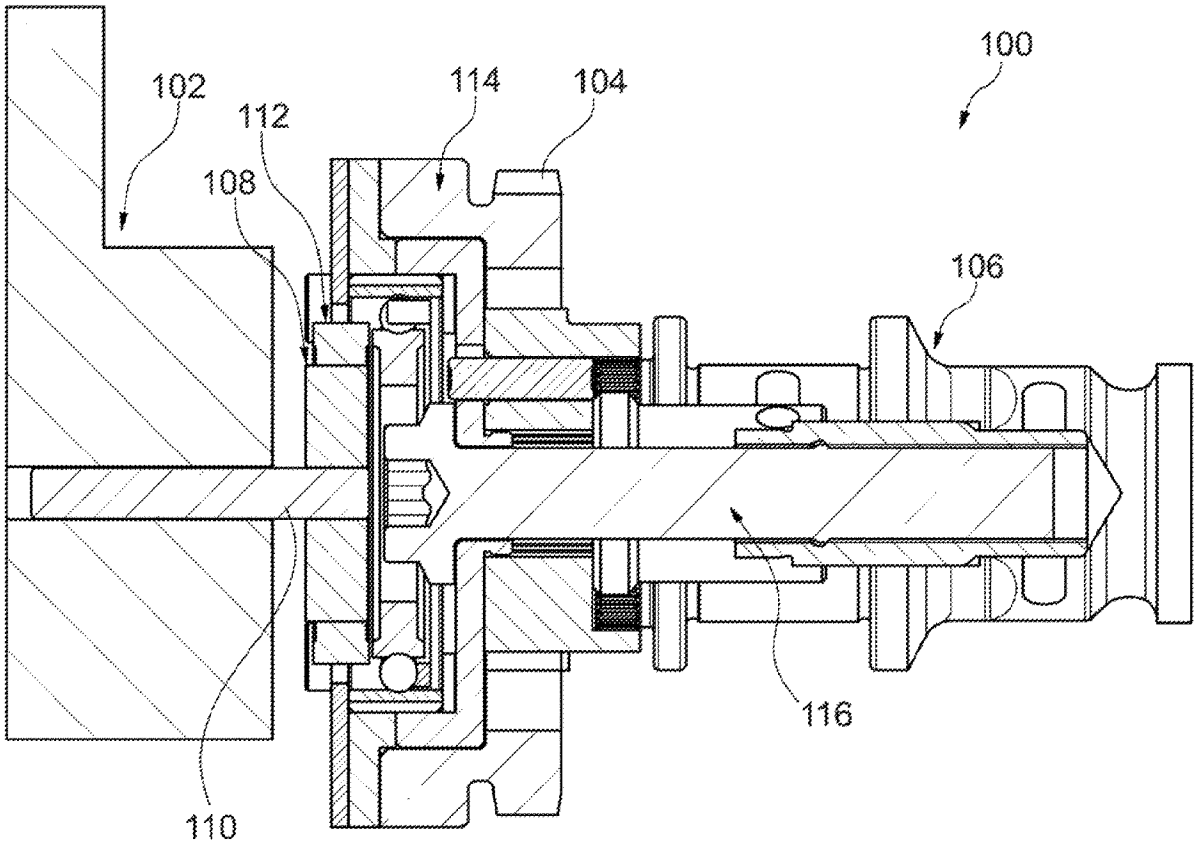
FIG. 1*a* shows a cross-sectional side view of a conventional electric cam phasing system.
Figure 1B:
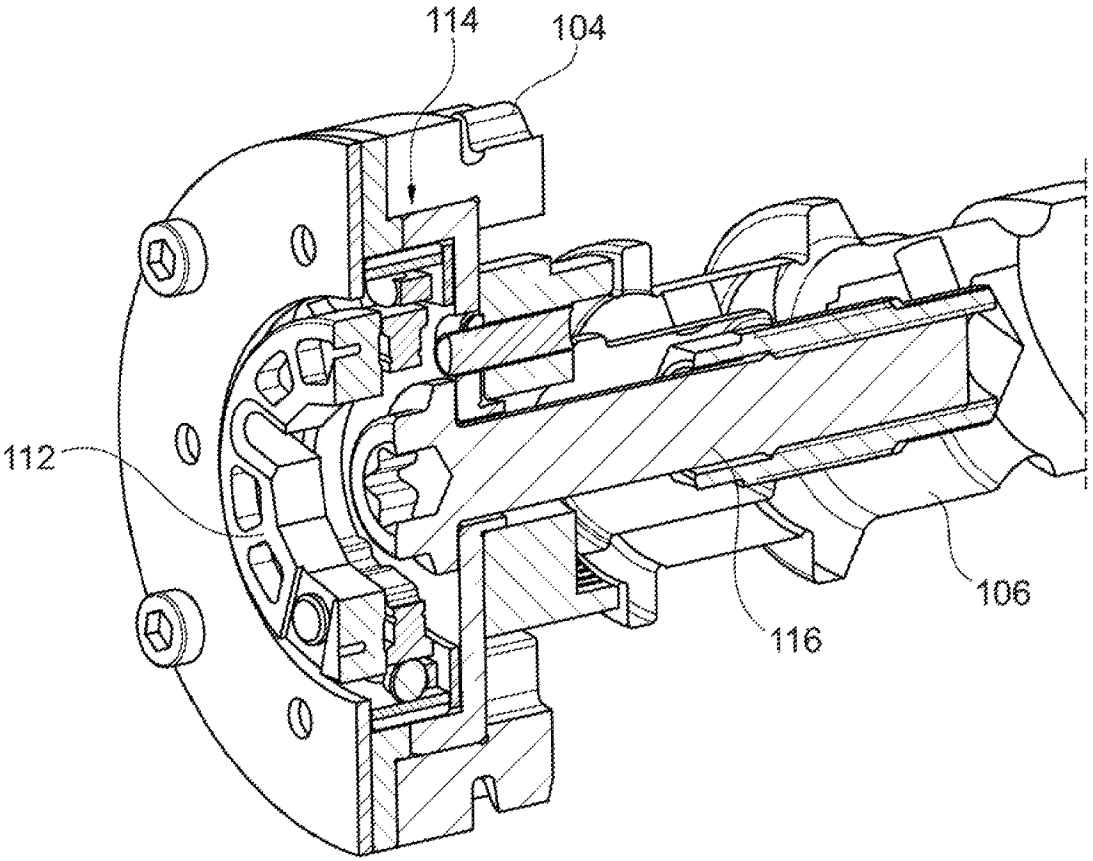
FIG. 1*b* shows an isometric view of a portion of the conventional electric cam phasing system
Figure 2:
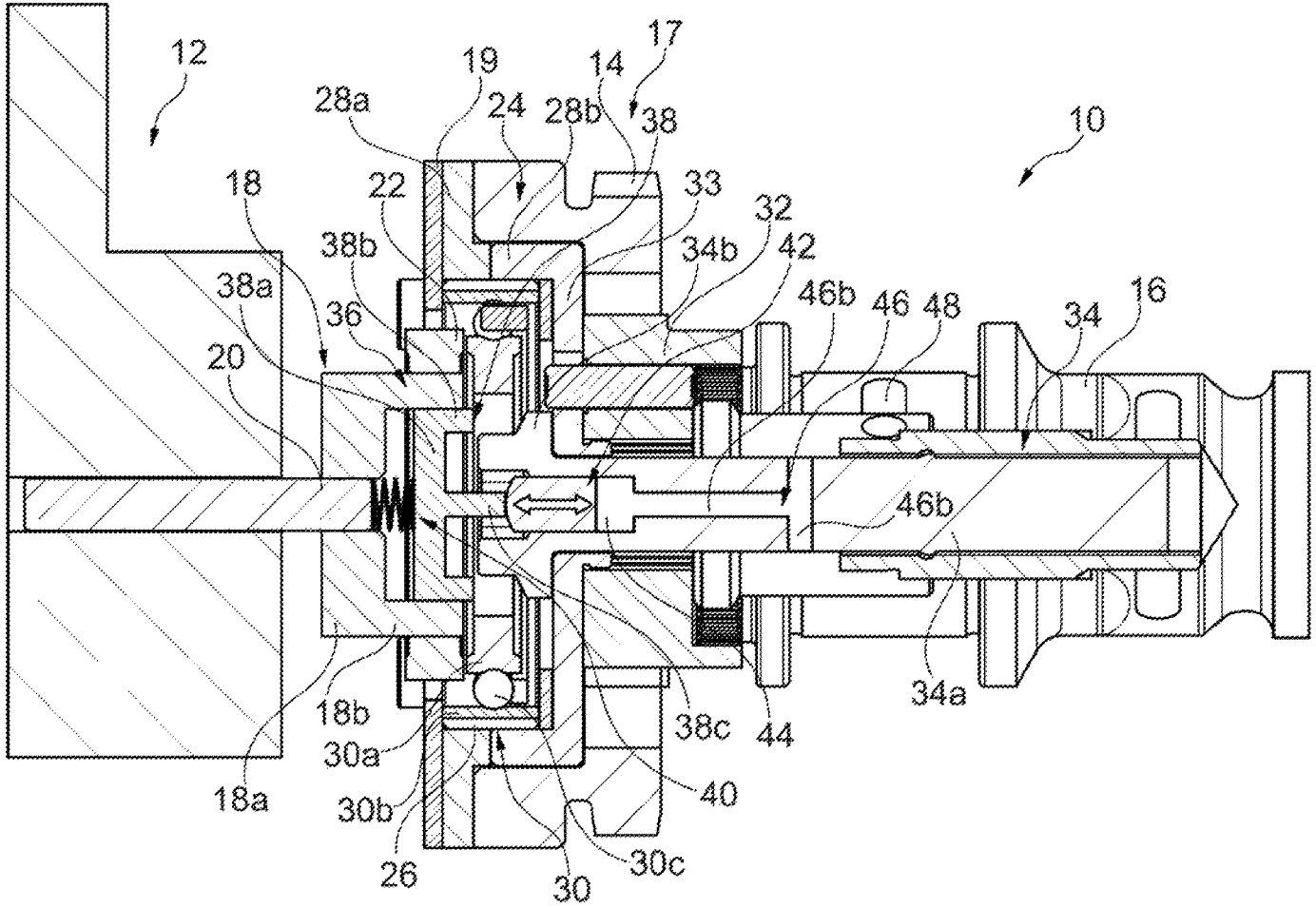
FIG. 2 shows a cross-sectional side view of cam phasing system including a lock in accordance with an embodiment of the present invention in an unlocked orientation with a camshaft bolt.

FIG. 2 shows a cross-sectional side view of an electric cam phasing system 10 configured for controllably varying the phase relationship between a crankshaft and a camshaft in an internal combustion engine in accordance with an embodiment of the present invention. Cam phasing system 10 includes an electric motor 12, a camshaft 16 and a gearbox 17 axially between electric motor 12 and camshaft 16. Electric motor 12 is configured for adjusting a position of a camshaft 16 relative to a sprocket 14 via a drive unit 24 of gearbox 17. Sprocket 14 couples the camshaft 16 to a crankshaft via a chain, belt, or gearing. System 10 includes a connector 18 at an end of a shaft 20 of motor 12 that is non-rotatably connected to an input shaft coupling 22 of a wave generator 30 of a drive unit 24. Drive unit 24, which in this embodiment is a harmonic drive unit, is configured for coupling camshaft 16 to sprocket 14 in a manner such that relative phasing of camshaft 16 with respect to sprocket 14 is adjustable via electric motor 12 driving wave generator 30. In this embodiment, gearbox 17 includes sprocket 14, a front cover 19, wave generator 30, an input gear 28*a*, an output unit 28*b* and an endstop disk 32. Wave generator 30, in addition to coupling 22, includes a flexible ring 26 having outwardly extending teeth and a ball bearing formed by an inner race 30*a*, an outer race 30*b*, and a plurality of balls 30*c* between outer race 30*b* and inner race 30*a*. Input gear 28*a* and output unit 28*b* each have inwardly extending teeth. Input shaft coupling 22 is nonrotatably fixed to inner race 30*a*, by for example pins that allow coupling 22 to slide off center of the inner race 30*a* to allow for minor misalignments between the centerline of shaft 20 and the centerline of camshaft 16. Sprocket 14 is nonrotatably fixed to input gear 28*a* and end stop disk 32, which is nonrotatably fixed to camshaft 16, is nonrotatably fixed to output unit 28*b*.

End stop disk 32 is sandwiched axially between an end of camshaft 16 and a radially extending section 33 of output unit 28*b*, which integrally fixed to second outer spline 28*b*, and is held axially against the end of camshaft 16 by a center fastener, which in this embodiment is a center bolt 34. Center bolt 34 includes a shaft 34*a* extending axially into a hollow bore within camshaft 16 such that a first end of bolt 34 is positioned within camshaft 16 and nonrotatably fixed to camshaft 16. A second end of bolt 34 includes a head 34*b* positioned within input shaft coupling 22 and abutting a radially extending surface of output unit 33.

Rotating the input shaft coupling 22 via motor 12 is the means by which camshaft 16 is rotated relative to sprocket 14 to change the valve timing. A gear ratio exists between input shaft coupling 22 and camshaft 16 that allows for relatively small rotations of the camshaft 16 when there are many rotations of the input shaft coupling 22. In normal operation with constant valve timing relative to the crankshaft, motor shaft 20 rotates at the same speed as camshaft 16. When valve timing is adjusted to either advance or retard the position of the camshaft 16, motor 12 either speeds up or slows down. During this adjustment, center bolt 34 and input shaft coupling 22 are no longer rotating at the same speed, but instead there is a relative rotation between bolt 34 and coupling 22. In order to prevent this relative rotation during engine shut down and engine start up, when there is a natural increase and decrease of oil pressure, system 10 is configured to lock gearbox 17 using this natural increase and decrease of oil pressure.

Figure 4:
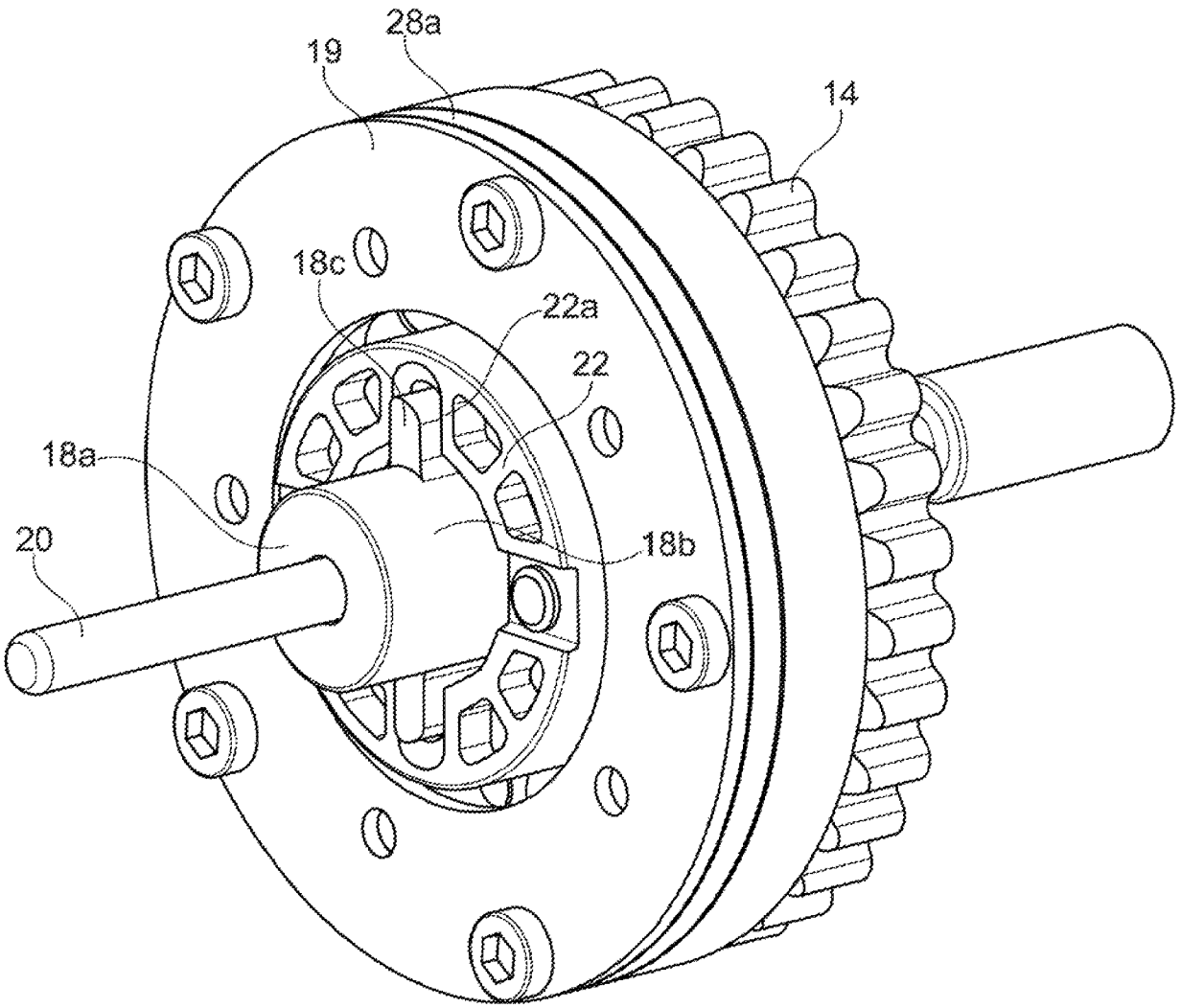
FIG. 4 shows a perspective view of cam phasing system shown in FIGS. 2 and 3.

For this purpose, cam phasing system 10 is configured in substantially the same manner as conventional system 100, but with a modified paddle forming a connector 18 and the addition of an activatable lock 36. Connector 18 includes a disc-shaped radially extending section 18*a* extending radially outward from shaft 20 and a cylindrically-shaped axially extending section 18*b* extending axially from a radially outer end of radially extending section 18*a*, with axially extending section 18*b* being provided with radially extending pins 18*c* that each extend radially outward from an outer circumferential surface of axially extending section 18*b* into a respective slot 22*a* formed in coupling 22, as shown in FIG. 4, which shows a perspective view of gearbox 17, shaft 20 and connector 18. An outer circumferential surface of axially extending section 18*b* is non-rotatably fixed to an inner circumferential surface of input shaft coupling 22 such that connector 18 is always engaged with coupling 22 and connector 18 and coupling 22 do not rotate relative to one another. Lock 36 is configured for selectively preventing a change in phase relationship between the crankshaft and camshaft 16 at a predetermined phase relationship. The natural increase and decrease of oil pressure during engine start up and shut down is used to engage and disengage lock 36.

More specifically, lock 36 is formed by an engager 38 configured for selectively engaging bolt head 34*b*, a compression spring 40 for acting axially on engager 38 and a movable element 42 received in an axially extending bore hole 44 formed in bolt 34. In this embodiment movable element 42 is a pin, but in other embodiments movable element may have another shape such as a sphere. In other embodiments, the movable element may be part of a check valve, as described further below with respect to FIGS. 9 and 10.

Engager 38 is fixed to the end of shaft 20 by spring 40 and is positioned axially between radially extending section 18*a* of connector 18 and bolt head 34*b*. Engager 38 is axially slidable within connector 18 with an outer diameter surface of engager 38 contacting an inner diameter surface of axially extending section 18*b* of connector 18. In order to engage an outer diameter surface of bolt head 34*b*, engager includes an axially extending section 38*b* protruding at the outer diameter of a radially extending base 38*a*, which formed as a plate. Radially extending base 38*a* and axially extending section 38*b* together have cup shape configured for receiving bolt head 34*b*.

An inner diameter surface of axially extending section 38*b* is contoured to match the outer diameter surface of bolt head 34*b* such that when the inner diameter surface of axially extending section 38*b* engages the outer diameter surface of bolt head 34*b*, engager 38 is nonrotatably connected to bolt head 34*b*. In other words, the inner diameter surface of axially extending section 38*b* is in the form of a socket too for engaging the pattern of the outer diameter surface of bolt head 34*b*. In one preferred embodiment, the inner diameter surface of axially extending section 38*b* of engager 38 and the outer diameter surface of bolt head 34*b* have corresponding hexagonal shapes. In other embodiments, such surfaces can have other corresponding shapes, for example rectangular or octagonal, or the surfaces can include intermeshing teeth. In further embodiments, such as in the embodiment shown in FIGS. 5 to 8, engager 38 may engage an inner diameter surface of bolt head 34*b* via features provided on an outer diameter surface of protrusion 38*c*. When engager 38 is disengaged from bolt head 34*b*, engager 38 and bolt 34 are free to rotate independently of one another. At a center thereof, engager 38 further includes a protrusion 38*c* protruding axially from radially extending base 38*a* toward camshaft 16 and into bore hole 44 to contact pin 42.

Bolt 34 also includes a fluid feed channel 46 formed therein for providing pressurized oil to bore hole 44 to force pin 42 axially into protrusion 38*c* of engager 38. Channel 46 includes at least one radially extending section 46*b* extending from an outer diameter surface of bolt shaft 34*a* and an axially extending section 46*a* extending axially from radially extending section 46*b*. Oil pressure supplied from the engine's oil circuit is provided to channel 46 from the cam bearing via a channel 48 extending radially through a cam shaft 16. In another embodiment, the center bolt can be configured for an axial oil feed from the center of camshaft 16.

FIG. 2 shows a view of system 10 when lock 36 is in the disengaged or unlocked orientation, such that gearbox 17 is unlocked and input shaft coupling 22 is free to rotate relative to bolt 34. In the unlocked orientation, the oil pressure from the engine circuit causes the oil pressure in channel 46 to reach a predetermined threshold that forces pin 42 axially toward engager 38 to such a degree that spring 40 is compressed and the inner diameter surface of axially extending section 38*b* of engager 38 is disengaged from the outer diameter surface of bolt head 34*b*.

Figure 3:
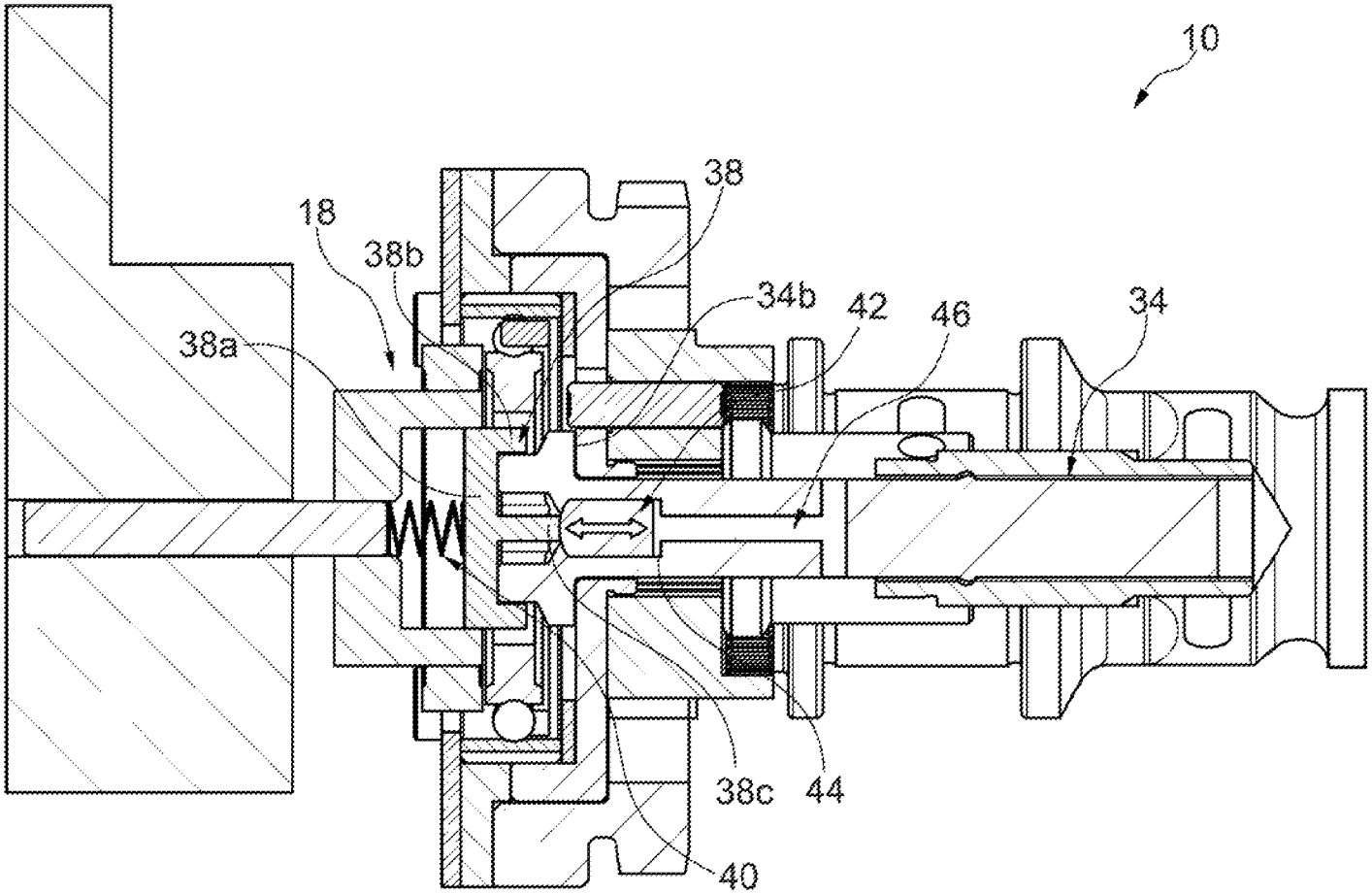
FIG. 3 shows a cross-sectional side view of cam phasing system shown in FIG. 2 in a locked orientation with the camshaft bolt.

In contrast, FIG. 3 shows a view of system 10 when lock 36 is in the engaged or locked orientation in which lock 36 functions to lock gearbox 17 by fixing input shaft coupling 22 to center bolt head 34*b* by way of engager 38 which fixes the valve timing at engine shut down and start up. More specifically, engager 38 fixes center bolt 34 to input shaft coupling 22 via spring 40 nonrotatably fixing engager 38 to center shaft 20 and connector 20 nonrotatably fixing input shaft coupling 22 to shaft 20. The outer diameter surface of engager 38 may also be nonrotatably connected to the inner diameter surface of axially extending section 18*b* in a manner that allows axial sliding of engager 38 with respect to connector 18, such as for example via flats on the outer diameter surface of engager 38 (such as flats 138*a* in FIG. 8) and the inner diameter surface of axially extending section 18*b* (such as flats 18*d* in FIG. 8). In the locked orientation, the oil pressure from the engine circuit is such that the oil pressure in channel 46 is below the predetermined threshold and the force of spring 40 is greater than the force of the oil pressure in channel 46 and protrusion 38*c* of engager 38 forces pin 42 axially toward channel 46 while the inner diameter surface of axially extending section 38*b* of engager 38 engages the outer diameter surface of bolt head 34*b*. As shown in FIG. 3, in the locked orientation, engager 38 still remains engaged in section 18*b* of connector 18 when engager 38 engages bolt head 34*b*.

At engine shut down, the oil pressure drops below the predetermined threshold and compression spring 40 overcomes the oil pressure behind pin 42 in channel 46 and, via engager 38, pushes pin 42 further into bore hole 44 in bolt 34, causing the inner diameter surface of axially extending section 38*b* of engager 38 to engage with the outer diameter surface of bolt head 34*b*.

At engine start up, gearbox 17 remains locked in the same exact position it was in at engine shut down via lock 36 until the oil pressure in channel 46 increases enough to overcome compression spring 40 and push pin 42 axially such that the inner diameter surface of axially extending section 38*b* of engager 38 is disengaged from the outer diameter surface off bolt head 34*b*. This disengagement allows input coupling shaft 22 to once again freely rotate relative to center bolt 34 when commanded to do so by motor 12 and a controller. Lock 36 remains in the unlocked orientation during the engine operation until the oil pressure falls below the predetermined threshold.

The control strategy for motor 12 requires gearbox 17 to be held in the desired lock position until engager 38 can be engaged with center bolt head 34*b*. This may require the control strategy to slowly adjust the rotation of input coupling 22 until the pattern of the inner diameter surface of axially extending section 38*b* of engager 38 can align with the pattern of the outer diameter surface of bolt head 34*b* and engage with bolt head 34*b*. The controller can determine this by monitoring electrical input (i.e., current) versus cam position. If a change in cam position is not detected when current is increased then the controller can consider the engager 38 engaged with the bolt head 34*b* and gearbox 17 locked. Likewise for the startup routine. The controller can apply a small torque in both directions until the oil pressure increases enough to push pin 42 out to compress spring 40 and disengage engager 38 from bolt head 34*b*. The release of torque can signal the controller that gearbox 17 is no longer locked and drive input shaft coupling 22 accordingly to the desired valve timing position.

Once engager 38 engages bolt head 34*b* and the phasing movement is locked, motor 12 is coasting and is driven by gearbox 17 and camshaft 16, as motor 12 is then being driven by camshaft 16. Once the controller senses that the gearbox phasing is prevented, the power can be cut to the motor 12 to allow such coasting.

Figure 5:
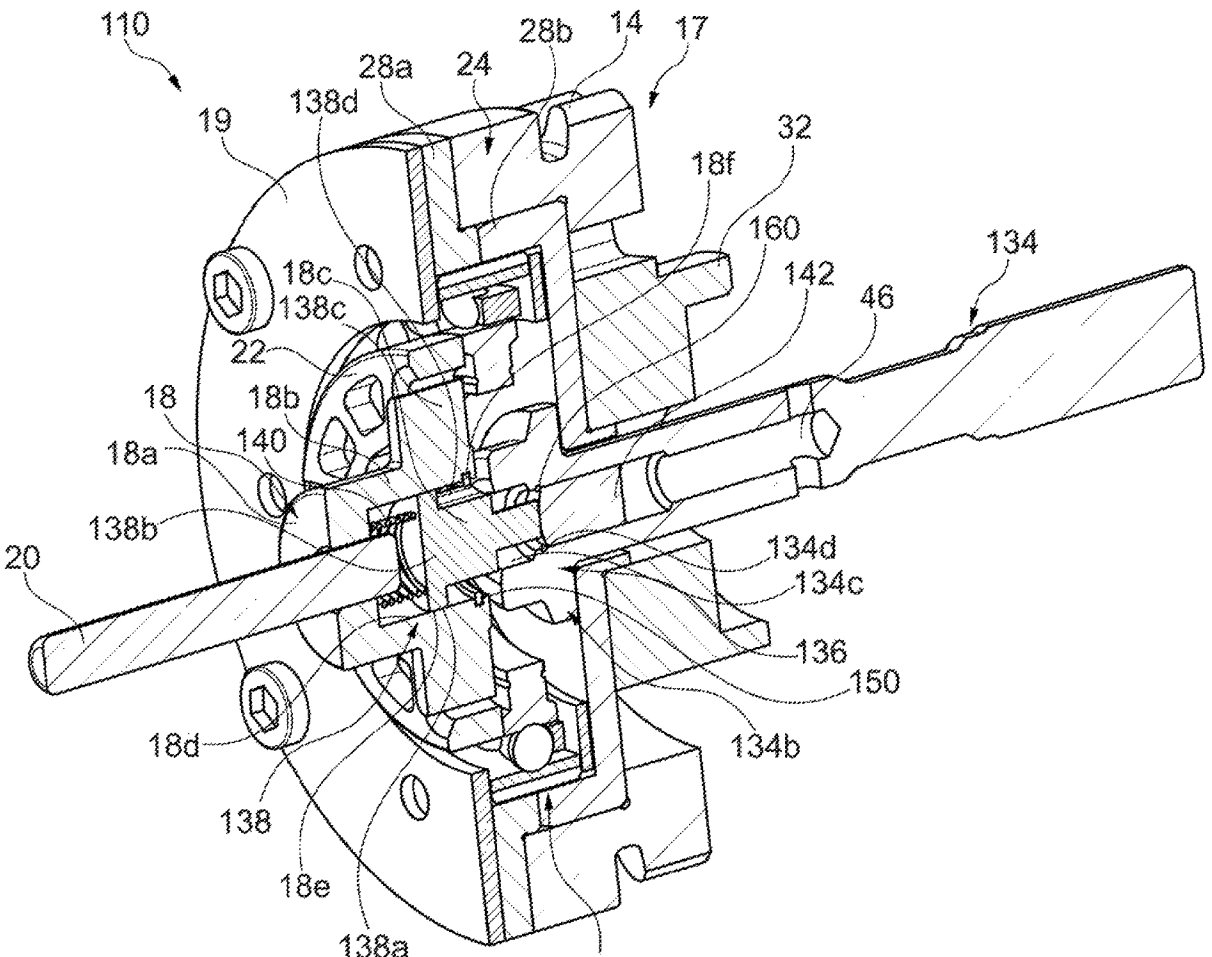
FIG. 5 shows a cut-away perspective view of a cam phasing system in accordance with another embodiment of the present invention.
Figure 6:
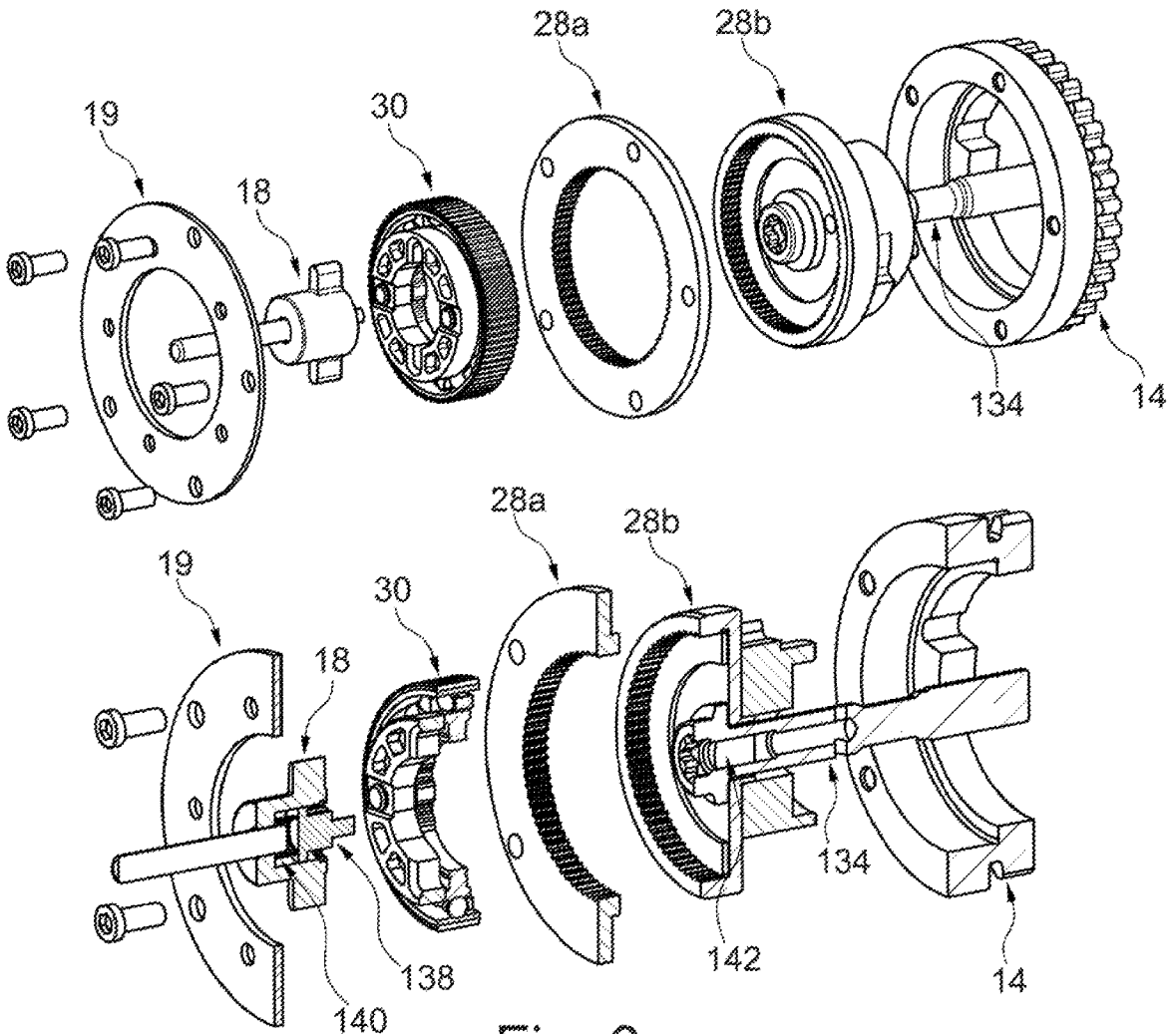
FIG. 6 shows an exploded view of the system shown in FIG. 5.

FIGS. 5 and 6 show a cam phasing system 110 in accordance with another embodiment of the present invention, with motor 12 and camshaft 16 being omitted for clarity. FIG. 5 shows a perspective view of system 110 and FIG. 6 shows an exploded view of system 110. Cam phasing system 110 is configured in the same manner as cam phasing system 10, includes the same shaft 20, gearbox 17 and camshaft 16 as system 10, with the sole differences being that an activatable lock 136 of system 110 is configured in a different manner than activatable lock 36 and a bolt head 134*b* of a bolt 134 has a different shape than bolt head 34*b*. Activatable lock 136 includes an engager 138, a spring 140 and a movable element 142.

Figure 7:
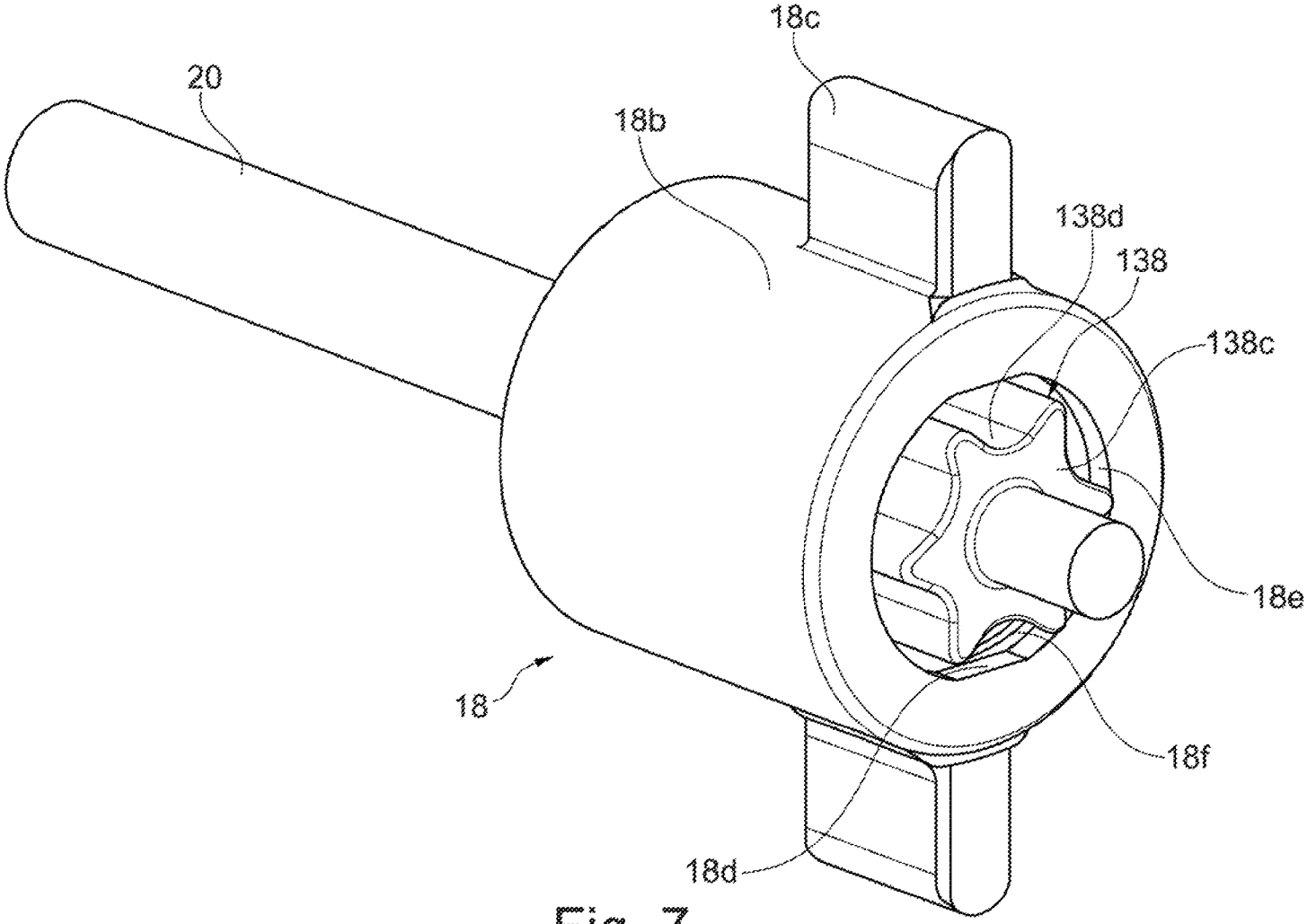
FIG. 7 shows an enlarged perspective view of the system shown in FIG. 5.
Figure 8:
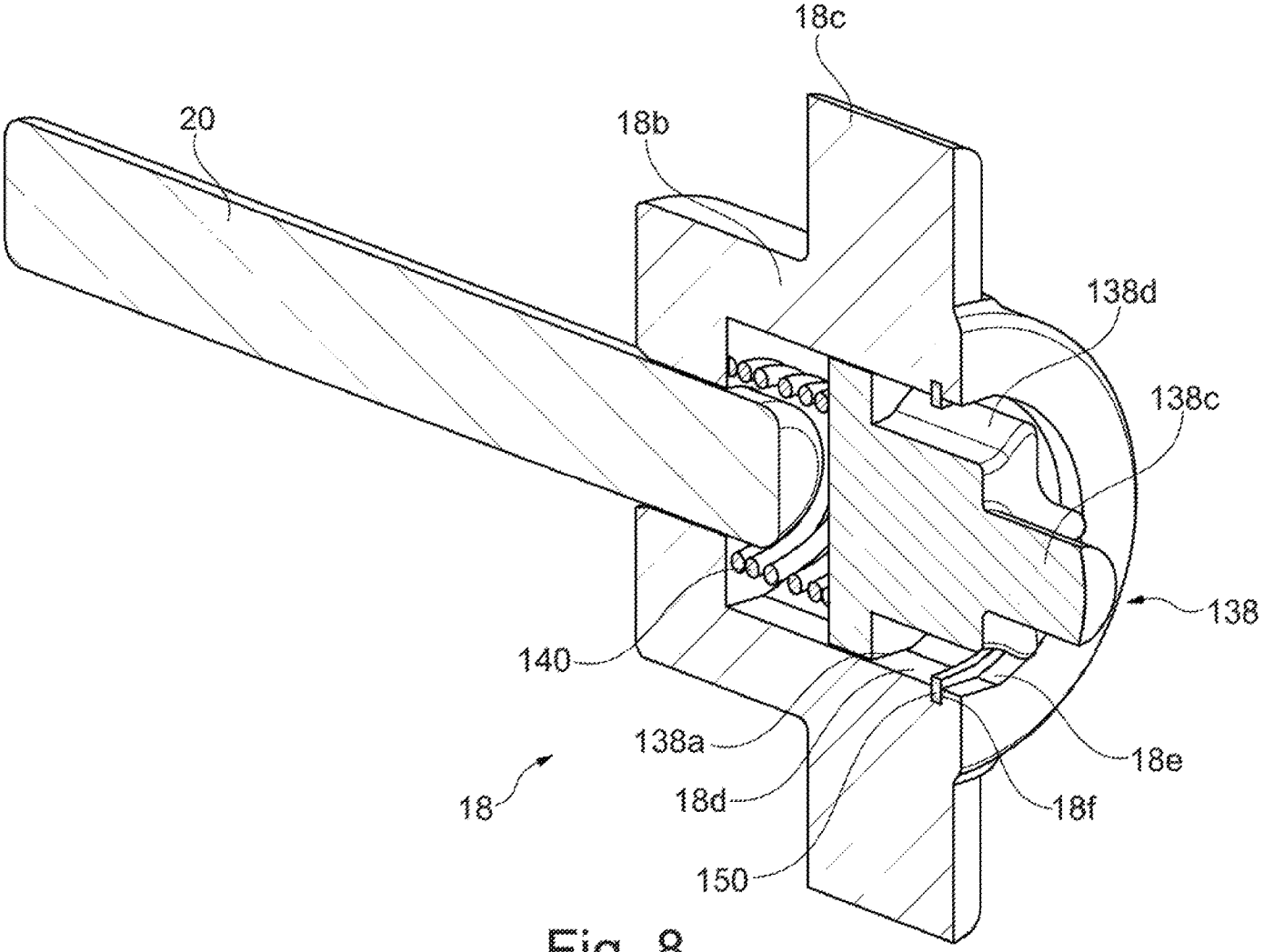
FIG. 8 shows an enlarged cut-away perspective view of the components shown in FIG. 7.

FIGS. 7 and 8 show an enlarged perspective view an enlarged cut-away perspective view, respectively, of shaft 20, connector 18, engager 138 and spring 140. As shown in FIGS. 5 to 8, engager 138 is nonrotatably connected to connector 18 by two flats 138*a* on a disc shaped base 138*b* of engager 138 engaging corresponding flats 18*d* formed in an inner circumferential surface 18*e* of axially extending section 18*b* of connector 18. Inner circumferential surface 18*e* is also provided with a circumferentially extending groove 18*f* formed therein receiving an elastic ring 150, which contacts base 138*b* of engager 138 to limit the axial movement of engager 138 away from shaft 20 and to prevent engager 138 from sliding out of connector 18 during assembly of system 110. Engager 138 includes a protrusion 138*c* protruding axially from base 138*b* toward bolt 134. As shown in detail in FIG. 7, protrusion 138*c* has an outer diameter surface 138*d* that is shaped to non-rotatably engage with an inner diameter surface 134*c* of bolt head 134*b*. In this embodiment, the outer diameter surface 138*d* of protrusion 138*c* and the inner diameter surface 134*c* of bolt head 134*b* both have a Torx-patterned shape, i.e., a shape including six teeth in the shape a six-pointed star. In other embodiments, such surfaces can have other corresponding shapes, for example rectangular or octagonal, or the surfaces can include intermeshing teeth of other shapes and/or numbers.

Spring 140 has a greater diameter than spring 40, and is not fixed to shaft 20 as in the embodiment shown in FIGS. 2 to 4, but is free to float in the cavity o connector 18. Spring 140 contacts a radially extending surface of section 18*a* of connector 18 to force engager 138 away from shaft 20. Movable element 142 is configured in substantially the same manner as movable element 42, with the addition that bolt 134 includes an annular snap-ring groove 134*d* at an inner diameter surface thereof that retains a snap ring 160, which prevents movable element 142 from sliding out of the bore in bolt 134 during installation. Activatable lock 136 functions in the same manner as lock 36 to selectively prevent a change in phase relationship between the crankshaft and camshaft 16 at a predetermined phase relationship using the natural increase and decrease of oil pressure during engine start up and shut down to engage and disengage lock 136.

In the disengaged or unlocked orientation, the oil pressure from the engine circuit causes the oil pressure in channel 46 to reach a predetermined threshold that forces pin 142 axially toward engager 138 to such a degree that spring 140 is compressed and the outer diameter surface 138*d* of protrusion 138*c* of engager 38 is disengaged from inner diameter surface 134*c* of bolt head 134*b*.

In the engaged or locked orientation, the oil pressure from the engine circuit is such that the oil pressure in channel 46 is below the predetermined threshold and the force of spring 140 is greater than the force of the oil pressure in channel 46 and protrusion 138*c* of engager 138 forces pin 142 axially toward channel 46 while outer diameter surface 138*d* of protrusion 138*c* of engager 38 engages inner diameter surface 134*c* of bolt head 134*b*.

Figure 9:
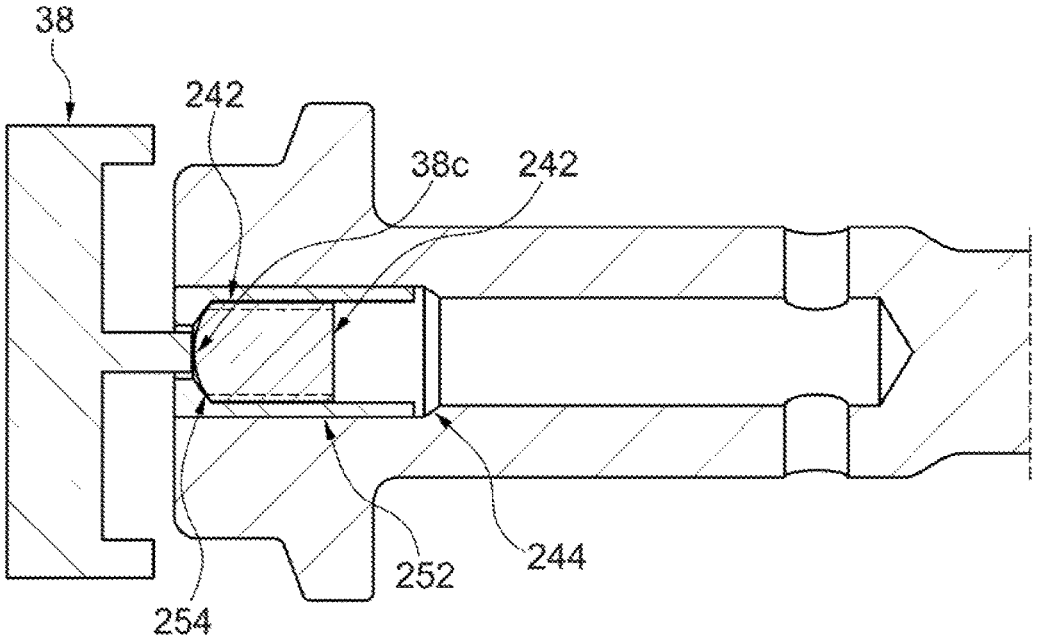
FIGS. 9 and 10 show an embodiment of the present invention in which a check valve is included in the camshaft bolt.
Figure 10:
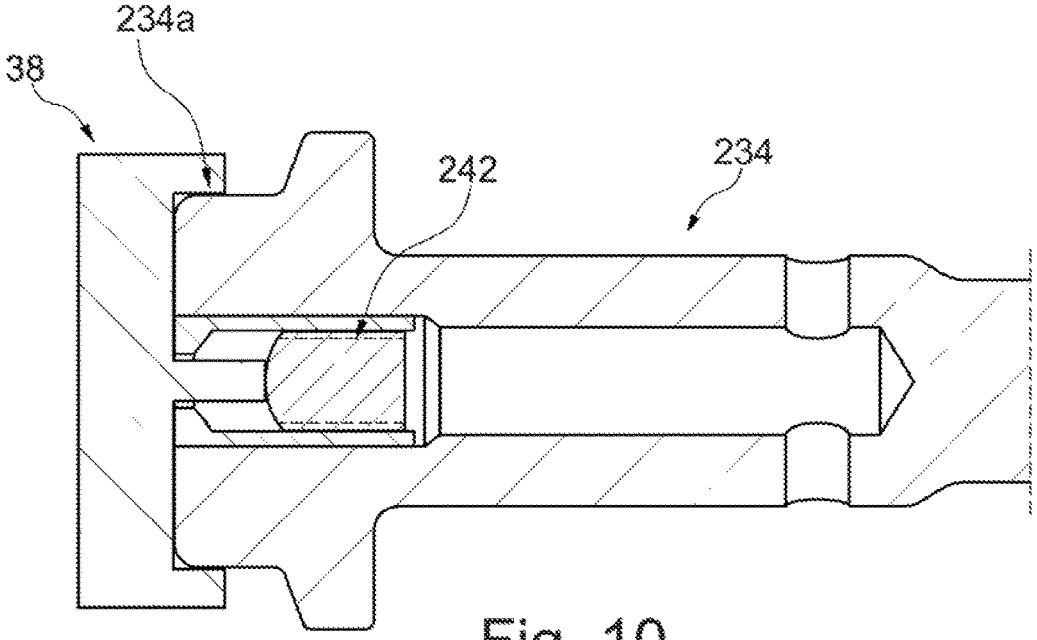

FIGS. 9 and 10 show an embodiment of the present invention in which the movable element 242 of the lock is part of a check valve 250. FIG. 9 shows check valve 250 in a closed position in which movable element 242 is in contact with a valve seat 254 of check valve 250 and FIG. 10 shows check valve 250 in the open position in which movable element 242 is spaced away from valve seat 254 by protrusion 38*c* of engager 38. In this embodiment, movable element 242 is a spherical ended cylinder—i.e., bullet-shaped, but in other embodiments, the movable element may be another shape, such as spherical.

Check valve 250 functions to relieve the oil in bore 244 through head 234*a* of bolt 234 to make it easier for the spring 40 (FIGS. 2, 3) or spring 140 (FIGS. 5, 6, 8) to push movable element 242 inside the bore 244 and engage the engager 38 or engager 138 (FIGS. 2, 3). Without this option, there may possibility be a risk in some designs that the spring 40, 140 does not have enough force to push movable element 242 because of the column of oil behind movable element 242 to be displaced. Check valve 250 can allow this oil to displace itself through bolt head 234*a* and enable faster reaction time for the engagement of the lock. Movable element 242, which is held in a valve housing 252 within bore 244, can function in the same manner as movable elements 42, 142 once the oil pressure falls below a predetermined value, as the force of spring 40, 140 overcome the force of oil pressure and moves movable element 242 further into center bolt 234. Once protrusion 38*c* of engager 38 moves movable element 242 away from valve seat 254, a series of channels either around the outer diameter of bolt 234 or holes axially aligned with bore 244 are opened that allow the fluid to drain through head 234. When there is oil pressure behind movable element 242, check valve 250 closes against seat 254 and prevents the draining of fluid through head 234.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An electric cam phasing system comprising:
an electric motor including a center shaft;
a center fastener configured for extending into a center of a camshaft, the center fastener being provided with a channel formed therein;
a gearbox including a sprocket and a drive unit, the drive unit including an input shaft coupling connected to the center shaft, the drive unit being configured for coupling the camshaft to the sprocket in a manner such that relative phasing of the camshaft with respect to sprocket is adjustable via the electric motor driving the drive unit; and
a lock positioned axially between the center shaft and the camshaft, the lock being configured for selectively engaging the center fastener to lock the gearbox in response to fluid pressure in the channel.

2. The electric cam phasing system as recited in claim 1 wherein the lock includes an engager non-rotatably connected to the center shaft and configured for moving axially with respect to the center shaft.

3. The electric cam phasing system as recited in claim 2 wherein the lock includes an axially acting spring elastically forcing the engager away from the center shaft.

4. The electric cam phasing system as recited in claim 3 wherein the spring nonrotatably fixes the engager to the center shaft.

5. The electric cam phasing system as recited in claim 2 wherein the center fastener is a center bolt including a bolt shaft extending into the camshaft and a bolt head, the engager including an axially extending section having an inner diameter surface configured for engaging an outer diameter surface of the bolt head to nonrotatably connect the engager to the bolt head to lock the gearbox.

6. The electric cam phasing system as recited in claim 2 wherein the center fastener is a center bolt including a bolt shaft extending into the camshaft and a bolt head, the engager including a protrusion having an outer diameter surface configured for engaging an inner diameter surface of the bolt head to nonrotatably connect the engager to the bolt head to lock the gearbox.

7. The electric cam phasing system as recited in claim 2 further comprising a connector nonrotatably fixed to the center shaft and nonrotatably fixed to the input shaft coupling.

8. The electric cam phasing system as recited in claim 7 wherein the connector includes an axially extending section configured for contacting an outer diameter surface of the engager to guide the engager during axial movement of the engager toward and away from the center fastener.

9. The electric cam phasing system as recited in claim 7 wherein the engager includes radially extending protrusions non-rotatably fixing the engager to the connector such that the engager is axially slidable with respect to the connector.

10. An electric cam phasing system comprising:
an electric motor including a center shaft;
a center fastener configured for extending into a center of a camshaft;
a gearbox including a sprocket and a drive unit, the drive unit including an input shaft coupling connected to the center shaft, the drive unit being configured for coupling the camshaft to the sprocket in a manner such that relative phasing of the camshaft with respect to sprocket is adjustable via the electric motor driving the drive unit; and
a lock positioned axially between the center shaft and the camshaft, the lock being configured for selectively engaging the center fastener to lock the gearbox,
wherein the lock includes an engager non-rotatably connected to the center shaft and configured for moving axially with respect to the center shaft,
wherein the lock includes an axially acting spring elastically forcing the engager away from the center shaft,
wherein the lock includes a movable element in a bore hole formed in the center fastener.

11. The electric cam phasing system as recited in claim 10 wherein the center fastener includes a channel formed therein configured for supplying the bore hole with pressurized fluid to force the movable element into contact with the engager, the spring forcing the engager into engagement with the center fastener when the pressurized fluid is below a predetermined threshold pressure, the movable element forcing the engager out of engagement with the center fastener when the pressure fluid is above the predetermined threshold pressure.

12. The electric cam phasing system as recited in claim 10 wherein the engager includes a protrusion extending into a head of the fastener to contact the movable element.

13. The electric cam phasing system as recited in claim 10 further comprising a check valve, the movable element being a part of the check valve.

14. A method of constructing an electric cam phasing system comprising:

nonrotatably fixing an input shaft coupling of a drive unit of a gearbox to a center shaft of an electric motor, the drive unit configured for coupling a camshaft to a sprocket in a manner such that relative phasing of the camshaft with respect to the sprocket is adjustable via the electric motor driving the drive unit;

fixing the drive unit to the camshaft via a center fastener extending into a center of the camshaft; and providing a lock positioned axially between the center shaft and the camshaft, the lock being configured for selectively engaging the center fastener to lock the gearbox.

15. The method as recited in claim 14 wherein the lock includes an engager for contacting a head of the center fastener to lock the gearbox, the providing the lock comprising connecting the engager to the center shaft such that the engager is axially movable via a spring with respect to the center shaft.

16. The method as recited in claim 15 wherein the lock includes a movable element, the providing the lock including placing the movable element in a bore hole formed in the center fastener.

17. The method as recited in claim 16 wherein the movable element is part of a check valve provided in the bore hole.

18. The method as recited in claim 16 wherein the center fastener includes a channel formed therein configured for supplying the bore hole with pressurized fluid to force the movable element into contact with the engager, the spring forcing the engager into engagement with the center fastener when the pressurized fluid is below a predetermined threshold pressure, the movable element forcing the engager out of engagement with the center fastener when the pressure fluid is above the predetermined threshold pressure.

19. The method as recited in claim 14 wherein the center fastener is a center bolt including a bolt shaft extending into the camshaft and a bolt head, the engager including an axially extending section having an inner diameter surface configured for engaging an outer diameter surface of the bolt head to nonrotatably connect the engager to the bolt head to lock the gearbox.

20. The method as recited in claim 14 wherein the center fastener is a center bolt including a bolt shaft extending into the camshaft and a bolt head, the engager including a protrusion having an outer diameter surface configured for engaging an inner diameter surface of the bolt head to nonrotatably connect the engager to the bolt head to lock the gearbox.

* * * * *